US006637340B1

(12) United States Patent
Wilson

(10) Patent No.: US 6,637,340 B1
(45) Date of Patent: Oct. 28, 2003

(54) RAIL PULLING SYSTEM

(76) Inventor: Timothy R. Wilson, 1805-2nd Ave. North, Moorhead, MN (US) 56560

( * ) Notice: Subject to any disclaimer, the term of this patent is extended or adjusted under 35 U.S.C. 154(b) by 0 days.

(21) Appl. No.: 10/260,472

(22) Filed: Sep. 26, 2002

(51) Int. Cl.[7] ..... E01B 29/04

(52) U.S. Cl. ..... 104/2; 104/7.2; 294/103.1; 294/106

(58) Field of Search ..... 104/2, 7.1, 7.2, 104/15, 307; 219/53, 54, 55, 97, 100; 294/85, 103.1, 106

(56) References Cited

U.S. PATENT DOCUMENTS 3,635,164 A * 1/1972 Patton ..... 104/307
3,731,635 A * 5/1973 Hambrick ..... 104/307
4,281,868 A * 8/1981 Lovitt ..... 294/106
4,342,263 A * 8/1982 Hurni ..... 104/7.2
4,414,454 A * 11/1983 Zollinger ..... 219/53
4,929,816 A * 5/1990 Theurer et al. ..... 219/53
4,983,801 A * 1/1991 Theurer et al. ..... 219/54
5,180,036 A * 1/1993 Boben ..... 188/1.11 E
5,270,514 A 12/1993 Wechselberger ..... 219/100
5,295,440 A * 3/1994 Cleveland ..... 104/7.2
5,297,482 A * 3/1994 Cleveland ..... 104/7.2

* cited by examiner

*Primary Examiner*—S. Joseph Morano
*Assistant Examiner*—Lars A. Olson
(74) *Attorney, Agent, or Firm*—Michael S. Neustel

(57) ABSTRACT

A rail pulling system for efficiently drawing the ends of two rails together. The rail pulling system includes an elongate frame, a control unit, a first sliding unit and a second sliding unit, a pair of first actuators attached to the first sliding unit, a pair of second actuators attached to the second sliding unit, a plurality of third actuators attached to the frame, a pair of first engaging cams rotatably attached to the first sliding unit, and a pair of second engaging cams rotatably attached to the second sliding unit. The cams are rotated to engage a first rail and a second rail respectively by actuating the first actuators and the second actuators thereby causing an engaging portion of the cams to engage pillow blocks on the third actuators. The third actuators then draw the first sliding unit and the second sliding unit together thereby drawing the rails together.

20 Claims, 11 Drawing Sheets

RAIL PULLING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to railroad rail pullers and more specifically it relates to a rail pulling system for efficiently drawing the ends of two rails together.

2. Description of the Related Art

It is often times necessary within the railroad industry to repair a length of rail that has become damaged. During repairs, sometimes the opposing ends of a first rail and a second rail are a significant distance apart and need to be drawn together for welding. Conventional rail pullers and other techniques are utilized to draw the two rails together for welding. U.S. Pat. No. 5,270,514 to Wechselberger et al. provides an example of the current art.

Conventional rail pullers are typically comprised of bulky structures that are difficult to maneuver and operate. In addition, conventional rail pullers are difficult to transport from one location to another.

While these devices may be suitable for the particular purpose to which they address, they are not as suitable for efficiently drawing the ends of two rails together. Conventional rail puller devices are bulky and difficult to utilize for drawing two rails together for welding.

In these respects, the rail pulling system according to the present invention substantially departs from the conventional concepts and designs of the prior art, and in so doing provides an apparatus primarily developed for the purpose of efficiently drawing the ends of two rails together.

BRIEF SUMMARY OF THE INVENTION

In view of the foregoing disadvantages inherent in the known types of rail pullers now present in the prior art, the present invention provides a new rail pulling system construction wherein the same can be utilized for efficiently drawing the ends of two rails together.

The general purpose of the present invention, which will be described subsequently in greater detail, is to provide a new rail pulling system that has many of the advantages of the rail puller devices mentioned heretofore and many novel features that result in a new rail pulling system which is not anticipated, rendered obvious, suggested, or even implied by any of the prior art rail pullers, either alone or in any combination thereof.

To attain this, the present invention generally comprises an elongate frame, a control unit, a first sliding unit and a second sliding unit, a pair of first actuators attached to the first sliding unit, a pair of second actuators attached to the second sliding unit, a plurality of third actuators attached to the frame, a pair of first engaging cams rotatably attached to the first sliding unit, and a pair of second engaging cams rotatably attached to the second sliding unit. The cams are rotated to engage a first rail and a second rail respectively by actuating the first actuators and the second actuators thereby causing an engaging portion of the cams to engage pillow blocks on the third actuators. The third actuators then draw the first sliding unit and the second sliding unit together thereby drawing the rails together.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a rail pulling system that will overcome the shortcomings of the prior art devices.

A second object is to provide a rail pulling system for efficiently drawing the ends of two rails together.

Another object is to provide a rail pulling system that safely draws two rails together.

An additional object is to provide a rail pulling system that is easily transported to and from a work site.

A further object is to provide a rail pulling system that retains a pair of rails adjacent to one another while being secured to one another.

Another object is to provide a rail pulling system that is capable of utilizing an external hydraulic unit.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
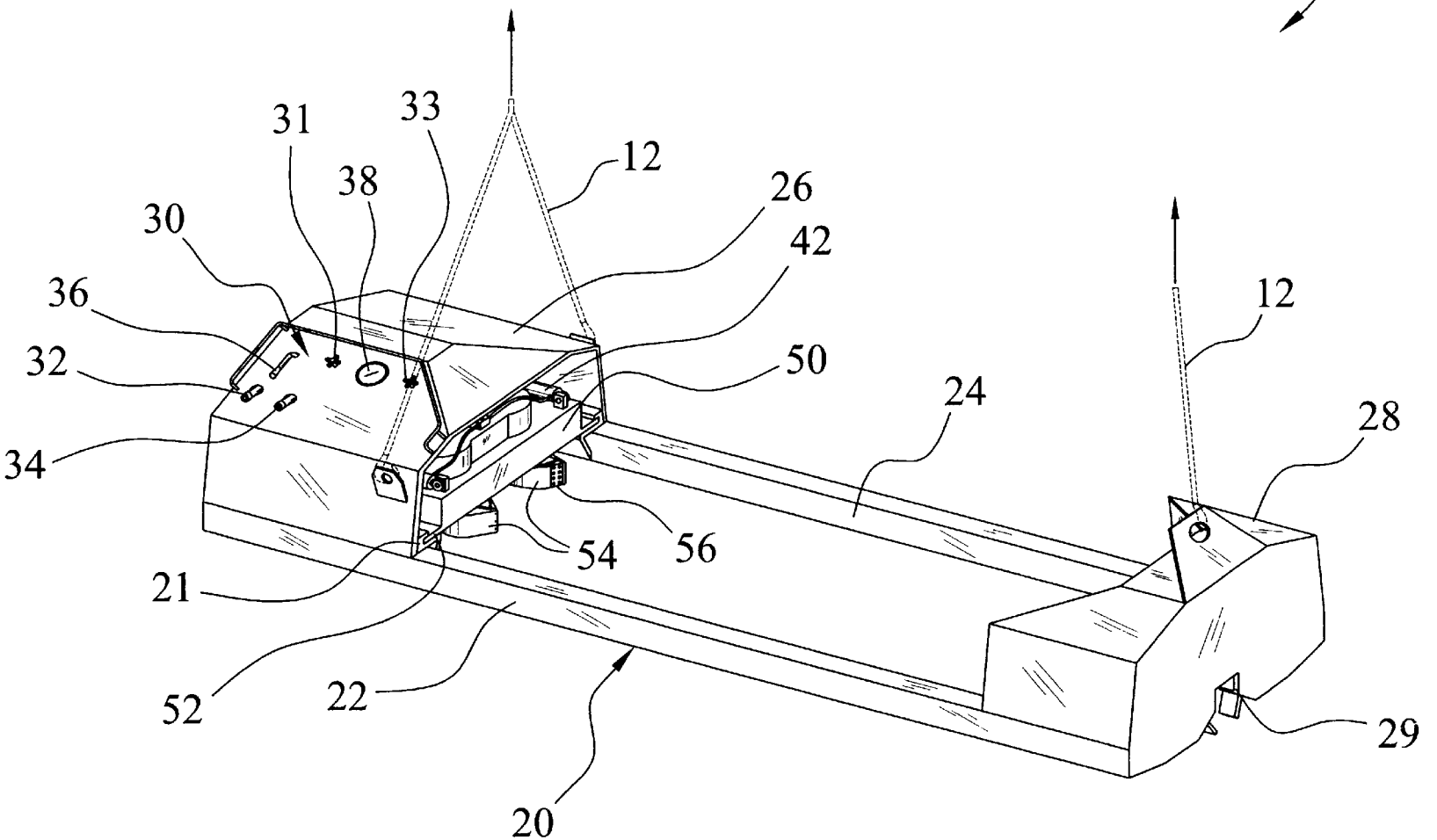
FIG. 1 is an upper perspective view of. the present invention. elevated with support cables.

Turning now descriptively to the drawings, in which similar reference characters denote similar elements throughout the several views, FIGS. 1 through 11 illustrate a rail pulling system 10, which comprises an elongate frame 20, a control unit 30, a first sliding unit 50 and a second sliding unit 60, a pair of first actuators 40 attached to the first sliding unit 50, a pair of second actuators 42 attached to the second sliding unit 60, a plurality of third actuators 44 attached to the frame 20, a pair of first engaging cams 54 rotatably attached to the first sliding unit 50, and a pair of second engaging cams 64 rotatably attached to the second sliding unit 60. The cams are rotated to engage a first rail 14 and a second rail 16 respectively by actuating the first actuators 40 and the second actuators 42 thereby causing an engaging portion of the cams to engage pillow blocks 46 on the third actuators 44. The third actuators 44 then draw the first sliding unit 50 and the second sliding unit 60 together thereby drawing the rails together.

Figure 2:
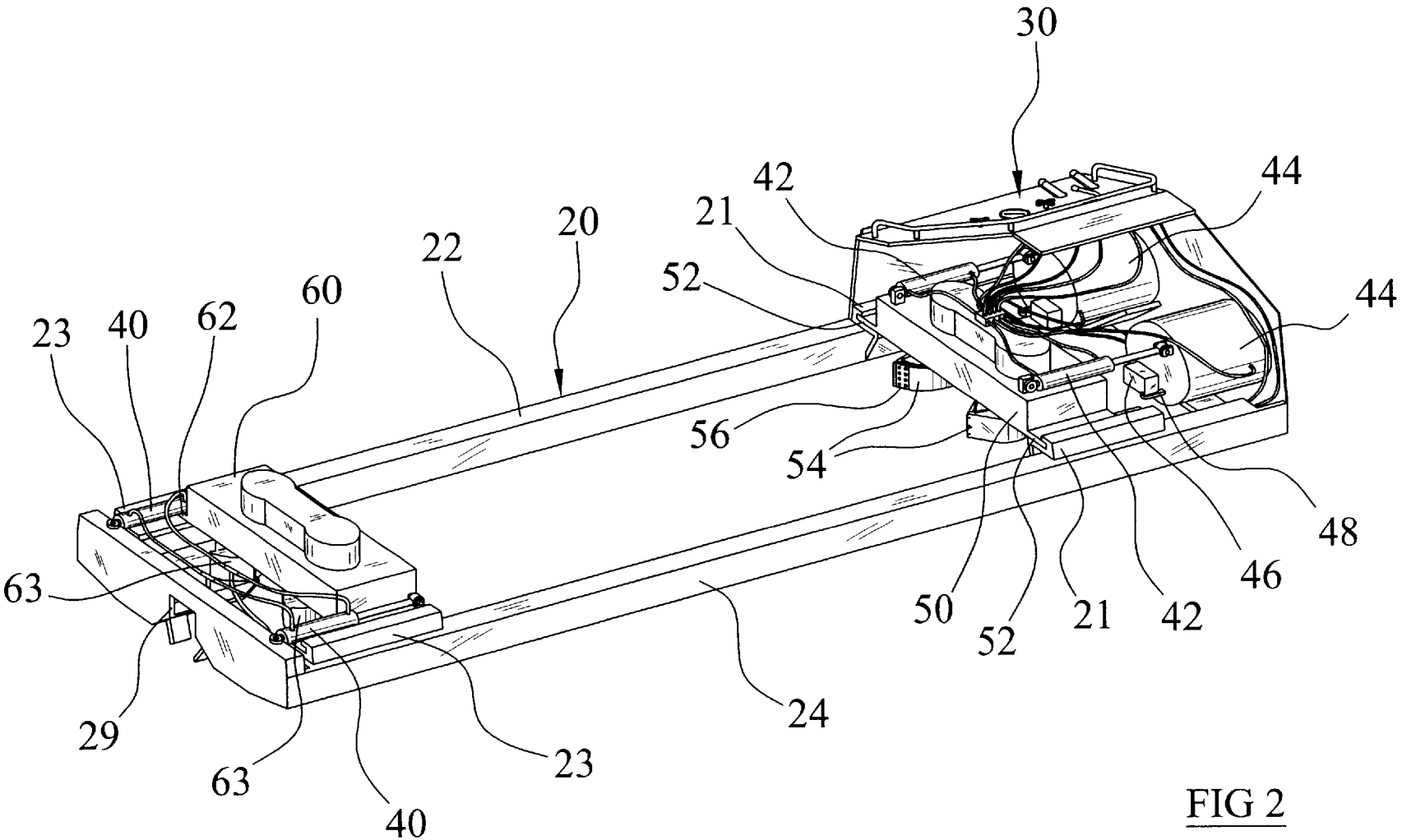
FIG. 2 is an upper perspective view of the present invention at a different angle with the covers removed.
Figure 3:
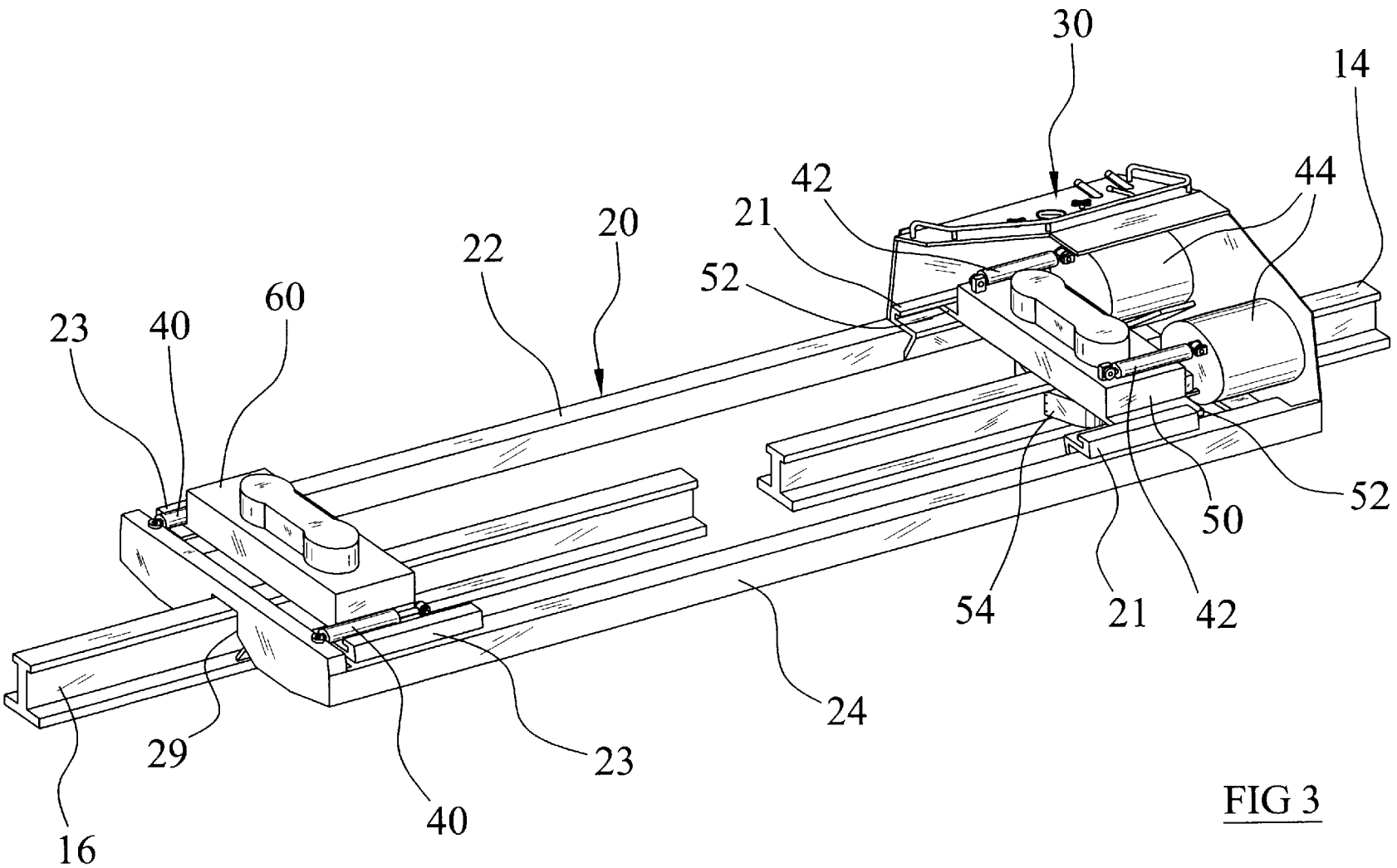
FIG. 3 is an upper perspective view of the present invention positioned about a first rail and a second rail.

As shown in FIGS. 1 through 3 of the drawings, the frame 20 is comprised of an elongate structure that is positionable about the first rail 14 and the second rail 16. The opposing ends of the frame 20 include receiver slots 29 for easily receiving the rails during operation of the present invention. The frame 20 preferably includes a first member 22 and a second member 24 extending between opposing ends of the frame 20. A first cover 26 encloses a portion of the first sliding unit 50 and a second cover 28 encloses a portion of the second sliding unit 60. It can be appreciated that various other structures may be utilized to construct the frame 20.

Figure 4:
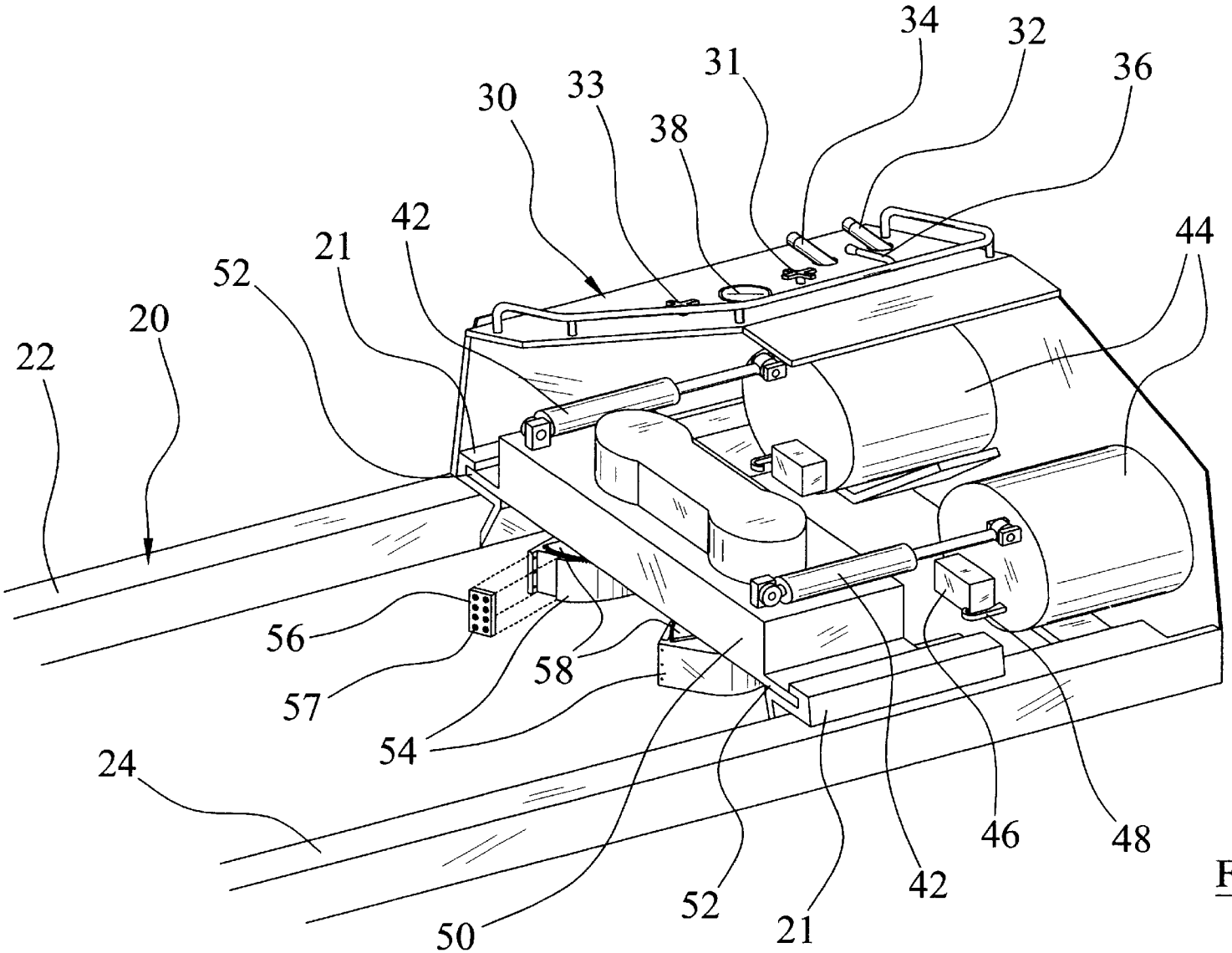
FIG. 4 is a magnified upper perspective view of the first sliding unit structure.
Figure 5:
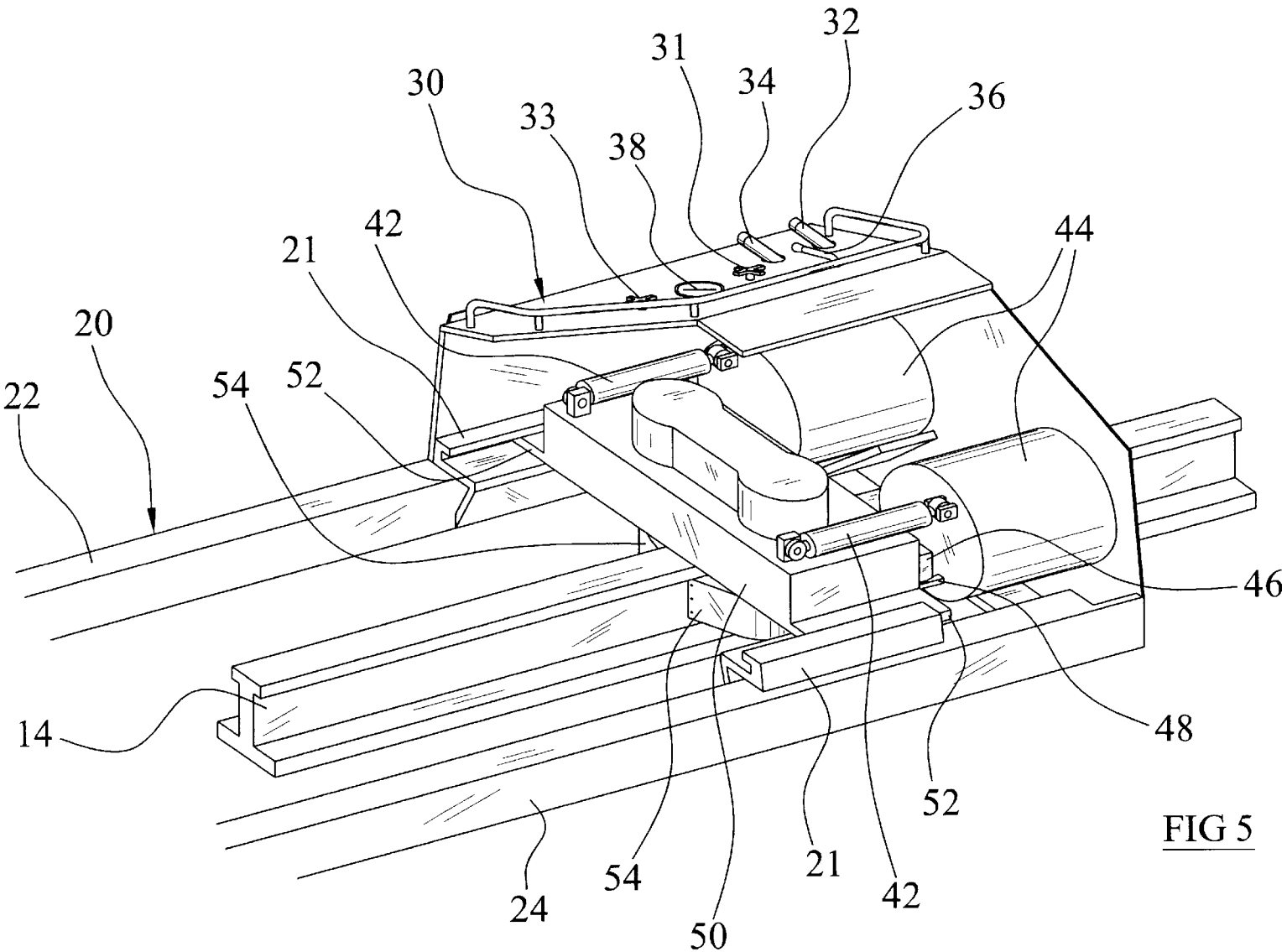
FIG. 5 is a magnified upper perspective view of the first sliding unit structure with the first engaging cams rotated to engage the first rail.

A pair of first support rails 21 or similar structure are attached near one end of the frame 20 as shown in FIG. 4 of the drawings. The first sliding unit 50 is slidably received within the first support rails 21. The first sliding unit 50 preferably has a pair of first tongues 52 that are slidably received within the first support rails 21 thereby allowing the first sliding unit 50 to slide along a longitudinal axis of the frame 20 a finite distance.

A pair of first engaging cams 54 are rotatably attached to the first sliding unit 50 in a mirrored manner. The first engaging cams 54 each have a face that is engageable with the first rail 14. The face of the first engaging cams 54 has a greater distance from a concentric position of the first engaging cams 54 that the remainder of the body of the first engaging cams 54 so that when rotated the face engages the first rail 14 in a compression and gripping manner.

The face of each of the first engaging cams 54 preferably has a slot that receives a first gripping member 56 in a replaceable manner. The first gripping member 56 preferably is comprised of a hardened metal for reduced wearing over extended usage. In addition, the first gripping member 56 preferably has a gripping pattern and/or a plurality of first teeth 57 for engaging the first rail 14. The teeth and/or the first gripping member 56 are preferably constructed of a strong material such as but not limited to high-speed steel. The teeth preferably have a plurality of extend nubs having a pointed structure for penetrating and gripping the side of the first rail 14. The first teeth 57 may also be removably and replaceable within the first gripping member 56 using a conventional fastener device.

Figure 6:
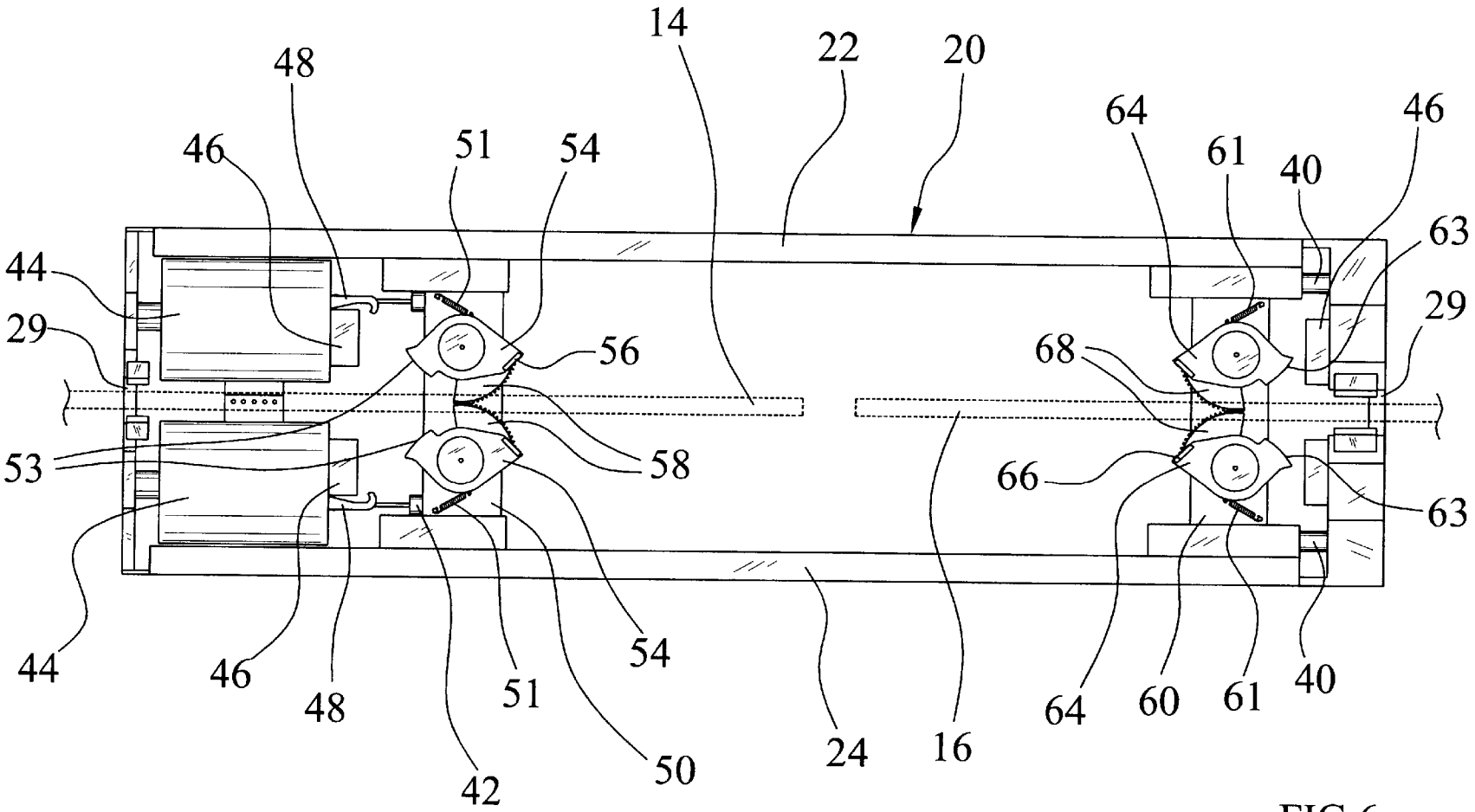
FIG. 6 is a bottom view of the present invention in the released position.

The first engaging cams 54 each have a first engaging portion 53 that is engageable upon pillow blocks 46 attached to the third actuators 44 as shown in FIG. 6 of the drawings. The first engaging portion 53 preferably has an extended end that is selectively engaged by hook members 48 extending from the third actuators 44 thereby releasing the first engaging cams 54 from the locked position when the first sliding unit 50 is extended away from the third actuators 44 as shown in FIGS. 6 through 9 of the drawings.

A pair of first sprockets 58 are attached to the first engaging cams 54 and are mechanically connected to one another in a geared manner thereby ensuring that the rotation of the first engaging cams 54 is synchronized. A pair of first springs.51 are attached to the frame 20 and to the first engaging cams 54 for causing a rotational force that opens the first engaging cams 54 when in the released position.

As best illustrated in FIGS. 4 through 9 of the drawings, the third actuators 44 are attached to an end of the frame 20. It can be appreciated that one or more third actuators 44 may be utilized with the present invention. The third actuators 44 each have a pillow block 46 that is engageable by the first engaging portion 53 of the first engaging cams 54. The third actuators 44 are formed for receiving a relatively high fluid pressure as they force the first rail 14 toward the second rail 16 at significant forces.

Figure 7:
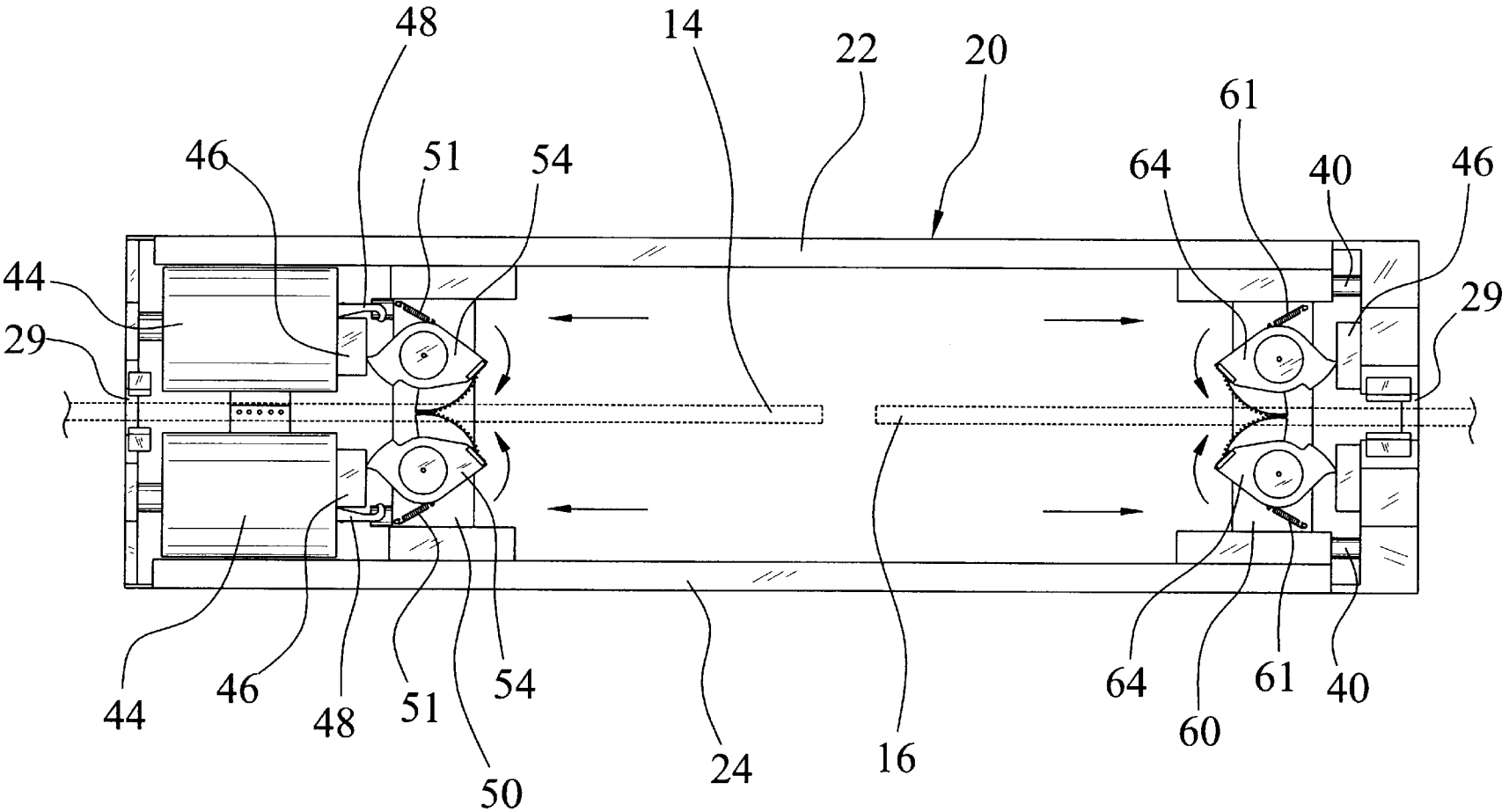
FIG. 7 is a bottom view of the present invention with the engaging cams rotated inwardly by the opposing sliding motions of the sliding units.
Figure 8:
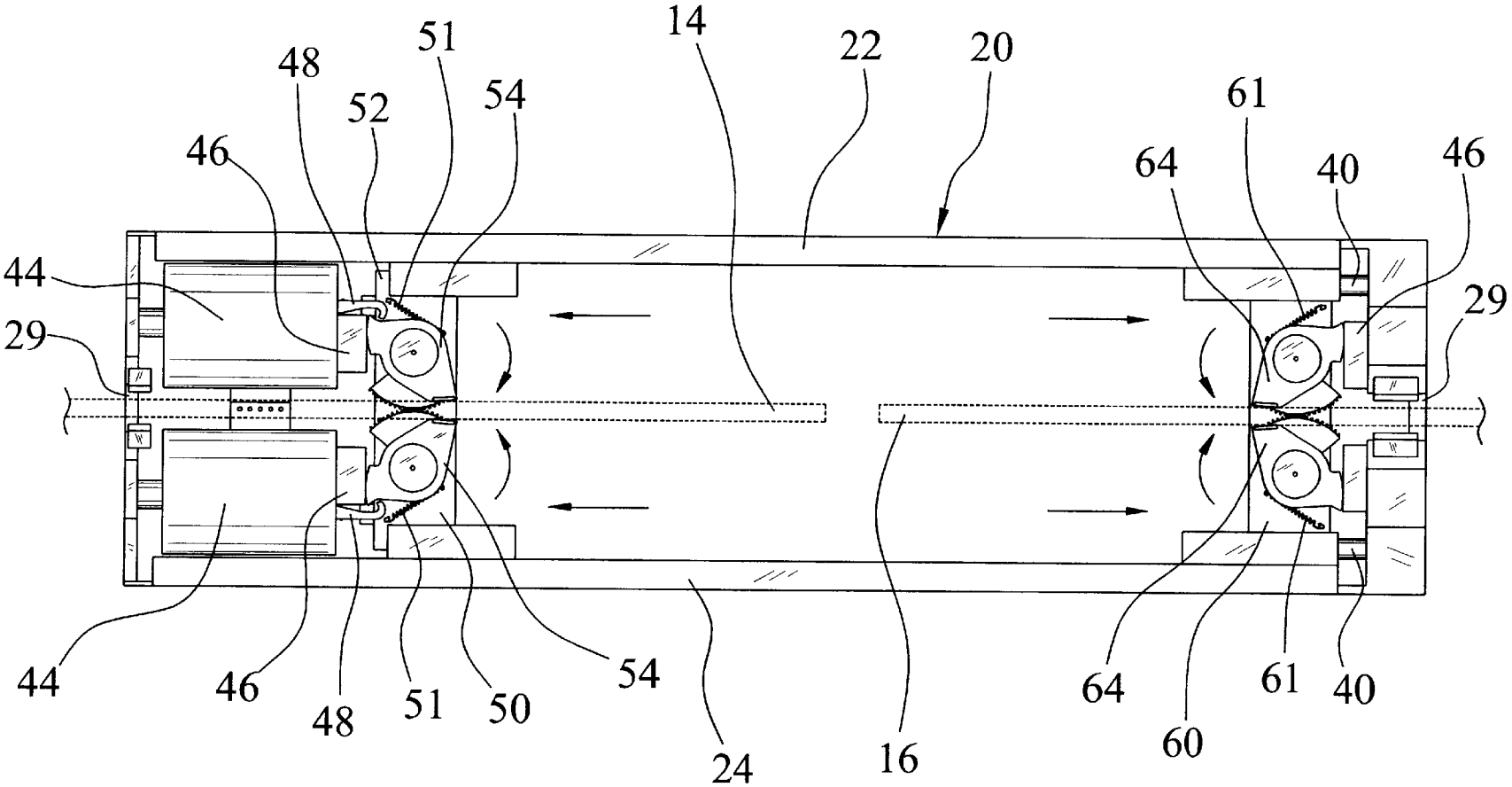
FIG. 8 is a bottom view of the present invention with the engaging cams in the. locked position.

One or more first actuators 40 are attached to the third actuators 44 and to the first sliding unit 50. The first actuators 40 are utilized to draw the first sliding unit 50 towards the third actuators 44 to engage the first engaging members against the first rail 14 as illustrated in FIGS. 7 and 8 of the drawings. The first actuators 40 are further utilized to cause the release of first engaging members from the first rail 14 by extending the first sliding unit 50 away from the third actuators 44.

A pair of second support rails 23 or similar structure are attached end of the frame 20 opposite of the first support rails 21 as shown in FIG. 3 of the drawings. The second sliding unit 60 is slidably received within the second support rails 23. The second sliding unit 60 preferably has a pair of second tongues 62 that are slidably received within the second support rails 23 thereby allowing the second sliding unit 60 to slide along a longitudinal axis of the frame 20 a finite distance.

A pair of second engaging cams 64 are rotatably attached to the second sliding unit 60 in a mirrored manner. The second engaging cams 64 each have a face that is engageable with the second rail 16. The face of the second engaging cams 64 has a greater distance from a concentric position of the second engaging cams 64 that the remainder of the body of the second engaging cams 64 so that when rotated the face engages the second rail 16 in a compression and gripping manner.

The face of each of the second engaging cams 64 preferably has a slot that receives a second gripping member in a replaceable manner. The second gripping member preferably is comprised of a hardened metal for reduced wearing over extended usage. In addition, the second gripping member preferably has a gripping pattern and/or a plurality of second teeth 67 for engaging the second rail 16. The teeth and/or the second gripping member are preferably constructed of a strong material such as but not limited to high-speed steel. The teeth preferably have a plurality of extend nubs having a pointed structure for penetrating and gripping the side of the second rail 16.

The second engaging cams 64 each have a second engaging portion 63 that is engageable upon pillow blocks 46 attached to the frame 20 as shown in FIG. 6 of the drawings. A pair of second sprockets 68 are attached to the second engaging cams 64 and are mechanically connected to one another in a geared manner thereby ensuring that the rotation of the second engaging cams 64 is synchronized. A pair of second springs 61 are attached to the frame 20 and to the second engaging cams 64 for causing a rotational force that opens the second engaging cams 64 when in the released position.

As shown in FIGS. 2 and 6 through 9 of the drawings, one or more first actuators 40 are connected between the frame 20 and the second sliding unit 60 for manipulating the position of the second sliding unit 60 upon the frame 20. When the first actuators 40 draw the second sliding unit 60 toward the end of the frame 20, the second engaging portion 63 of the second engaging cams 64 engages the pillow blocks 46 attached to the frame 20 thereby causing the second engaging cams 64 to rotate and engage the second rail 16 positioned between the second engaging cams 64.

A control unit 30 is preferably attached to the frame 20. The control unit 30 preferably is fluidly connectable to a hydraulic unit 18, which is permanently built into the present invention, or an external hydraulic unit 18. The control unit 30 has an inlet port 32 for receiving the pressurized hydraulic fluid and an outlet port 34 for returning the fluid to the hydraulic unit 18. A lock valve 31 within the control unit 30 allows for the operator to lock the pressure within the actuators 40, 42, 44 thereby allowing for removal of the hydraulic unit 18 for use upon another site. A release valve 33 is positioned within the control unit 30 for allowing for release of hydraulic fluid within the actuators 40, 42, 44. At least one control lever 36 allows for control of hydraulic fluid flow to the actuators 40, 42, 44. A pressure gauge 38 within the control unit 30 indicates the fluid pressure within the actuators 40, 42, 44 thereby indicating the amount of force being applied to the rails 16, 18.

The actuators 40, 42, 44 are preferably comprised of a hydraulic cylinder device that receive pressurized hydraulic fluid. However, the actuators 40, 42, 44 may be comprised of an electrical actuator device controlled by the control unit 30 electronically. Various other well-known actuator devices may be utilized as the actuators 40, 42, 44.

Figure 9:
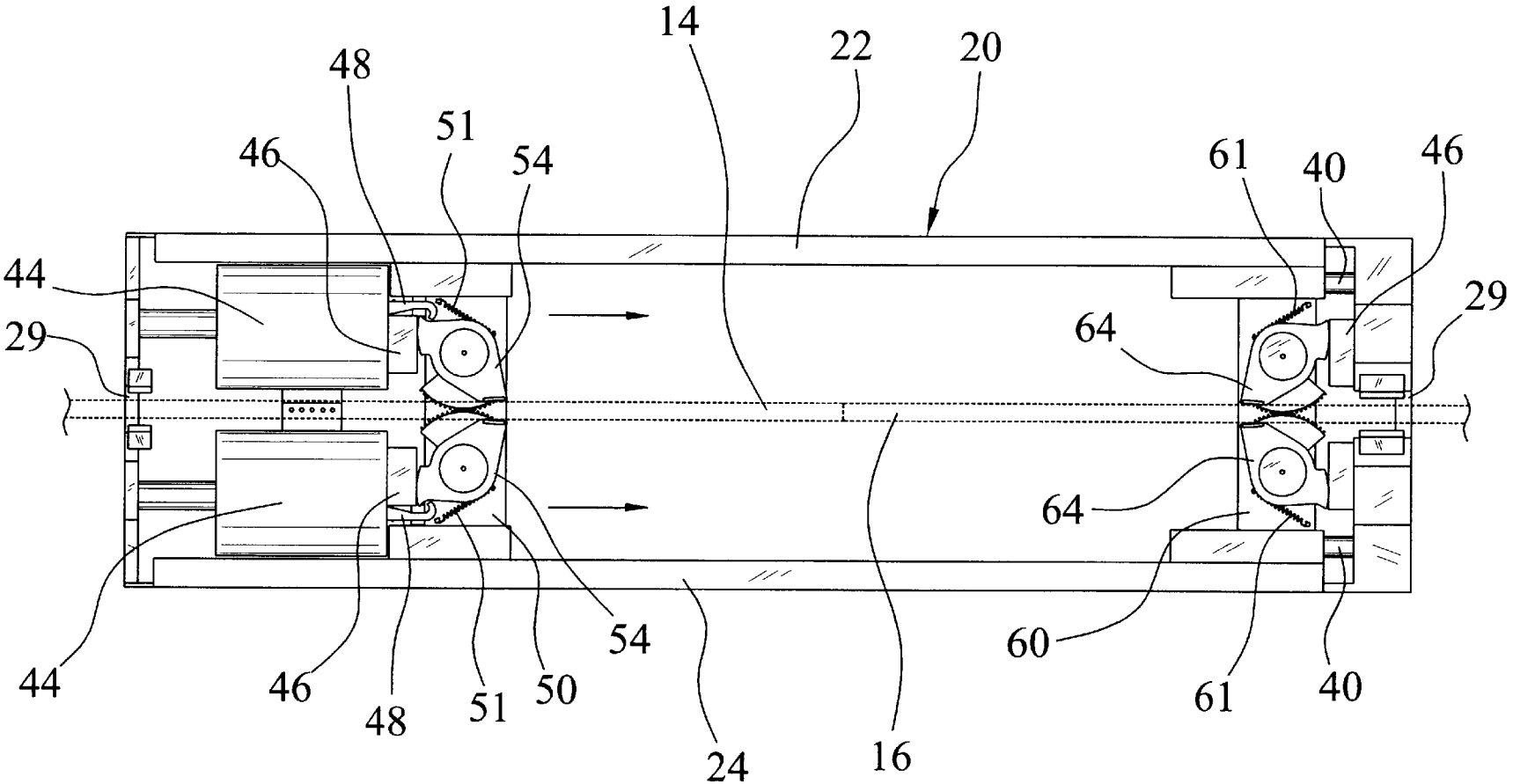
FIG. 9 is a bottom view of the present invention illustrating the third actuators drawing the second rail toward the first rail.
Figure 10:
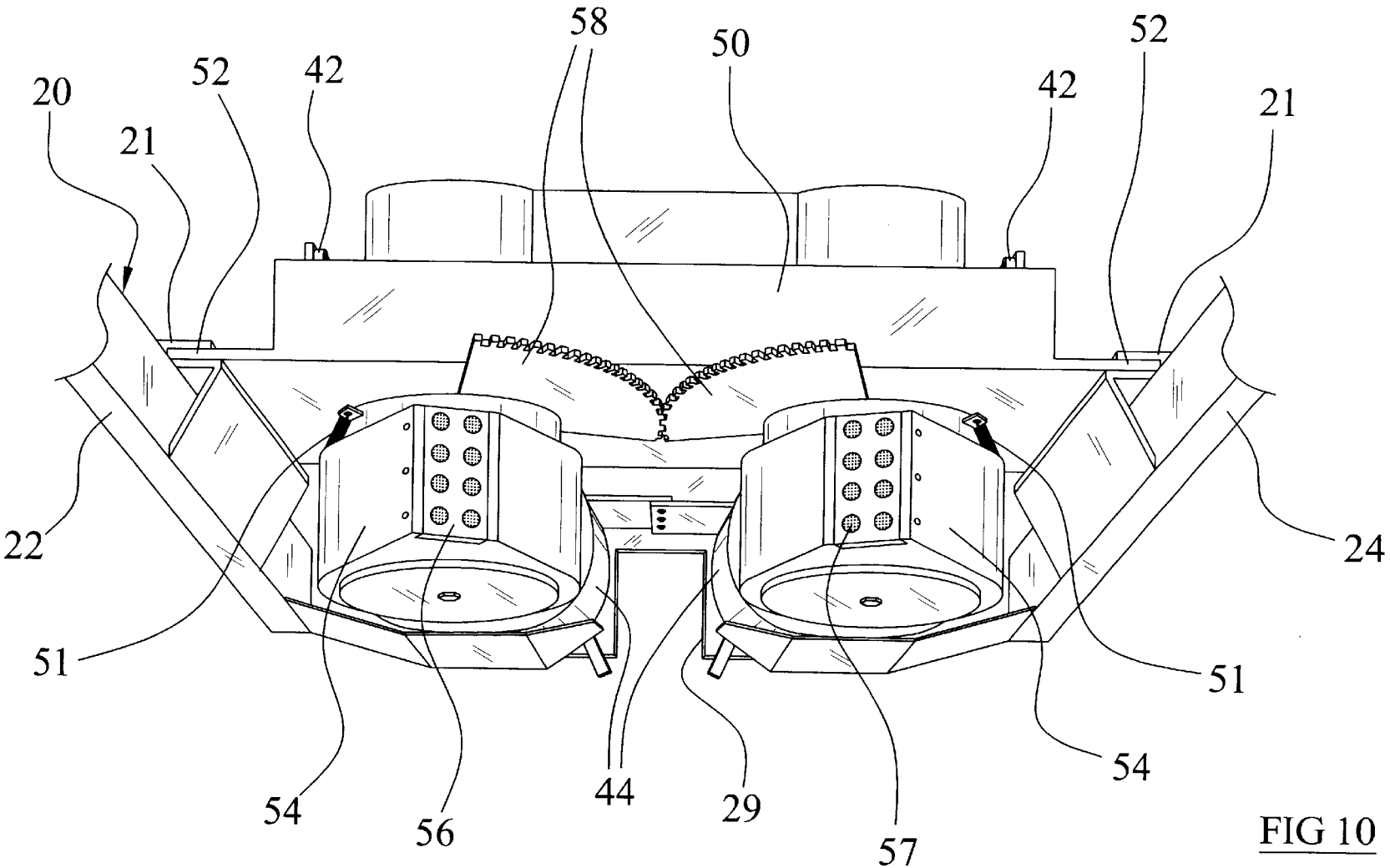
FIG. 10 is a magnified lower perspective view of the first engaging cams.
Figure 11:
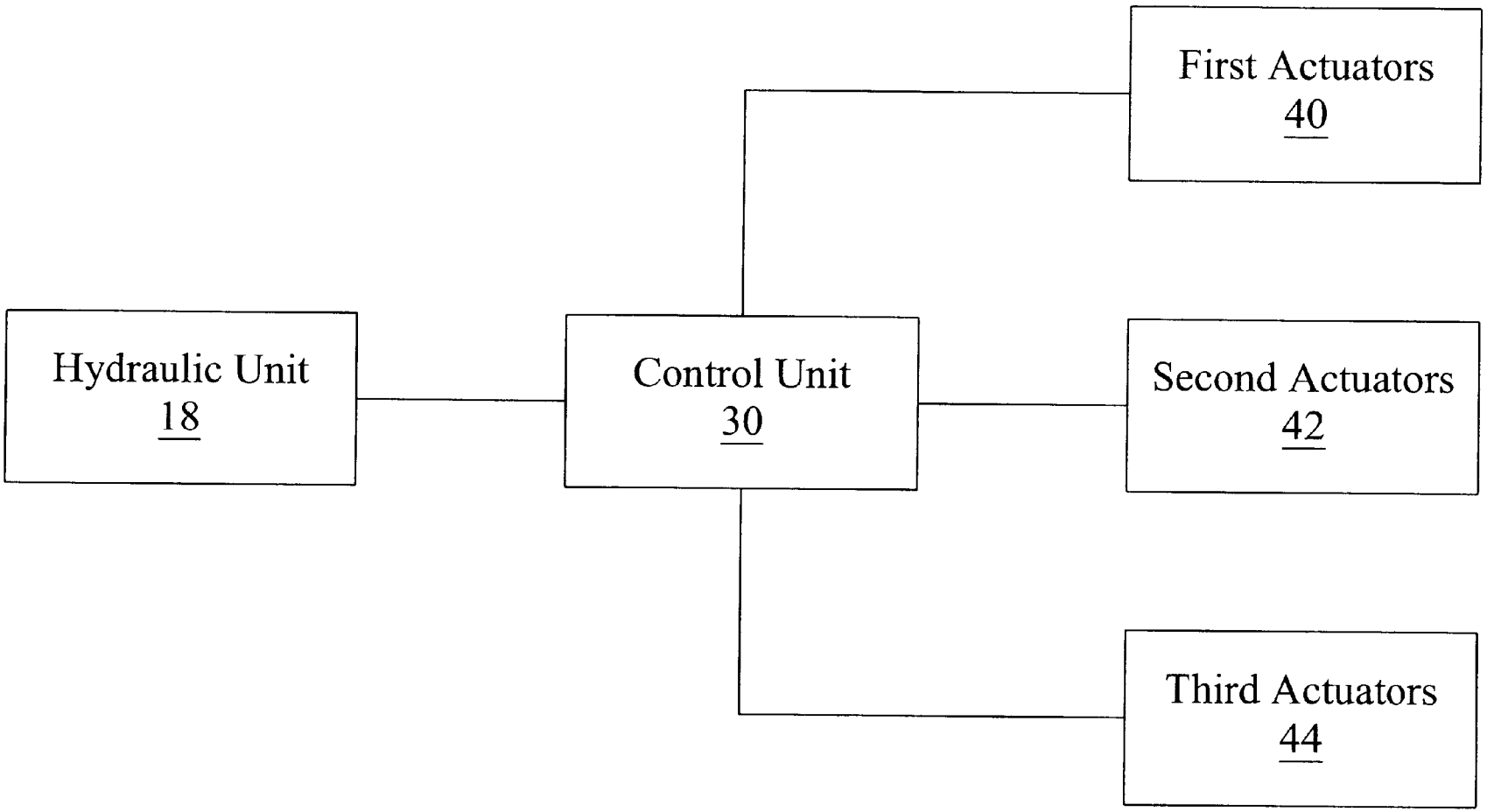
FIG. 11 is a block diagram of the fluid connections of the present invention.

In use, the user positions the present invention about the first rail 14 and the second rail 16 using an elevating device connected to the frame 20 by a support cable 12 or similar connecting structure as shown in FIG. 1 of the drawings. After properly positioned about the rails 14, 16, the user then retracts the first actuators 40 to draw the second engaging portion 63 of the second engaging cams 64 against the pillow blocks 46 thereby rotating the second engaging cams 64 so that the opposing second gripping members 66 engage the opposing sides of the second rail 16 as shown in FIGS. 7 and 8 of the drawings. After the second engaging cams 64 are properly secured to the second rail 16, the user then retracts the second actuators 42 to draw the first engaging portion 53 of the first engaging cams 54 against the pillow blocks 46 thereby rotating the first engaging cams 54 so that the opposing first gripping members 56 engage the opposing sides of the first rail 14 as shown in FIGS. 7 and 8 of the drawings. After the engaging cams 54, 64 are properly engaged against the rails 14, 16, the user then extends the third actuators 44 causing the first sliding unit 50 along with the first rail 14 to be drawn closer to the second rail 16 as shown in FIG. 9 of the drawings. The force of the third actuators 44 is applied directly to the first engaging portion 53 of the first engaging cams 54 thereby simultaneously increasing the gripping force of the first engaging cams 54 against the first rail 14. The pulling forces also force the second engaging portion 63 of the second engaging cams 64 thereby simultaneously increasing the gripping force of the second engaging cams 64 against the second rail 16. Once the ends of the rails 14, 16 are adjacent to one another, the operator then activates the lock valve 31 to provide a safe environment to weld the first rail 14 to the second rail 16 (e.g. a butt weld) or attach the rails 14, 16 via a different means. Once the rails 14, 16 are properly secured to one another, the operator releases the pressure within the third actuators 44. The operator then extends the second actuators 42 thereby causing the first sliding unit 50 to be forced away from the third actuators 44 thereby causing the hook members 48 to engage the extend portion of the first engaging portion 53 of each of the first engaging cams 54 which releases the first engaging cams 54 from the first rail 14. The operator then extends the first actuators 40 thereby facilitating release of the second engaging cams 64 from the second rail 16. The first springs 51 and the second springs 61 further assist in rotating the engaging cams 54, 64 from the rails 14, 16. The present invention is then removed from the rails 14, 16 and transported to another work site.

As to a further discussion of the manner of usage and operation of the present invention, the same should be apparent from the above description. Accordingly, no further discussion relating to the manner of usage and Operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rail pulling system for drawing a first rail and a second rail together, comprising:

a frame having a first end and a second end;

a first unit slidably attached to said frame;

a pair of first engaging cams rotatably attached to said first unit in opposition to one another for engaging a first rail;

a first actuator attached to said first end of said frame;

a second actuator attached between said first unit and said first actuator;

a second unit attached to said frame; and a pair of second engaging cams rotatably attached to said second unit in opposition to one another for selectively engaging a second rail.

2. The rail pulling system of claim 1, wherein said pair of first engaging cams each mirror one another.

3. The rail pulling system of claim 1, wherein said pair of first engaging cams each has an engaging face for engaging a first rail.

4. The rail pulling system of claim 3, wherein said engaging face includes a first gripping member.

5. The rail pulling system of claim 4, wherein said first gripping member is removable.

6. The rail pulling system of claim 4, wherein each of said first engaging cams includes a slot for receiving said first gripping member.

7. The rail pulling system of claim 4, wherein said gripping member includes a plurality of first teeth.

8. The rail pulling system of claim 1, wherein said first engaging cams include an extended portion and wherein a pair of hook members extend from said first actuators to engage said extended portion when said first unit is moved away from said first actuators thereby releasing said first engaging cams.

9. The rail pulling system of claim 1, including a first spring attached to said first engaging cams for applying a release force to said first engaging cams.

10. The rail pulling system of claim 1, wherein each of said first engaging cams have an engaging face and an inner face, wherein said engaging face has a distance greater from a concentric point of each of said first engaging cams than said inner face.

11. A rail pulling system for drawing a first rail and a second rail together, comprising:

a frame having a first end and a second end;

a first unit slidably attached to said frame;

a pair of first engaging cams rotatably attached to said first unit in opposition to one another for engaging a first rail;

a first actuator attached to said first end of said frame;

a second actuator attached between said first unit and said first actuator;

wherein said first engaging cams each include a first engaging portion that selectively engage a corresponding first pillow block attached to said first actuator a second unit slidably attached to said frame;

a pair of second engaging cams rotatably attached to said second unit in opposition to one another for selectively engaging a second rail, wherein said second engaging cams each include a second engaging portion that selectively engage a corresponding second pillow block attached to said frame; and a third actuator attached between said second unit and said frame.

12. The rail pulling system of claim 11, wherein said pair of first engaging cams each mirror one another.

13. The rail pulling system of claim 11, wherein said pair of first engaging cams each has an engaging face for engaging a first rail.

14. The rail pulling system of claim 13, wherein said engaging face includes a first gripping member.

15. The rail pulling system of claim 14, wherein said first gripping member is removable.

16. The rail pulling system of claim 14, wherein each of said first engaging cams includes a slot for receiving said first gripping member.

17. The rail pulling system of claim 14, wherein said gripping member includes a plurality of first teeth.

18. The rail pulling system of claim 11, wherein said first engaging cams include an extended portion and wherein a pair of hook members extend from said first actuators to engage said extended portion when said first unit is moved away from said first actuators thereby releasing said first engaging cams.

19. The rail pulling system of claim 11, including a first spring attached to said first engaging cams for applying a release force to said first engaging cams.

20. The rail pulling system of claim 11, wherein each of said first engaging cams have an engaging face and an inner face, wherein said engaging face has a distance greater from a concentric point of each of said first engaging cams than said inner face.

* * * * *